US010948198B2

(12) United States Patent
Könneker

(10) Patent No.: US 10,948,198 B2
(45) Date of Patent: Mar. 16, 2021

(54) INSERT FOR A DOWNDRAFT EXTRACTOR

(71) Applicant: Wilhelm Bruckbauer, Neubeuern (DE)

(72) Inventor: Walter Könneker, Rosenheim (DE)

(73) Assignee: Wilhelm Bruckbauer, Neubeuern (DE)

( * ) Notice: Subject to any disclaimer, the term of this patent is extended or adjusted under 35 U.S.C. 154(b) by 84 days.

(21) Appl. No.: 16/311,915

(22) PCT Filed: Jun. 22, 2017

(86) PCT No.: PCT/EP2017/065410
§ 371 (c)(1),
(2) Date: Dec. 20, 2018

(87) PCT Pub. No.: WO2017/220728
PCT Pub. Date: Dec. 28, 2017

(65) Prior Publication Data

US 2019/0203949 A1 Jul. 4, 2019

(30) Foreign Application Priority Data

Jun. 22, 2016 (DE) ..... 10 2016 211 206.6

(51) Int. Cl.
*F24C 15/20* (2006.01)

(52) U.S. Cl.
CPC ..... *F24C 15/2021* (2013.01); *F24C 15/2042* (2013.01)

(58) Field of Classification Search
CPC ... F24C 15/20; F24C 15/2035; F24C 15/2042
See application file for complete search history.

(56) References Cited

U.S. PATENT DOCUMENTS

| | | | | |
|---|---|---|---|---|
| 4,071,739 | A | 1/1978 | Jenn et al. | |
| 4,962,694 | A * | 10/1990 | Graver | A47J 36/38 126/21 A |
| 6,455,818 | B1 * | 9/2002 | Arntz | F24C 15/2042 126/299 R |
| 10,006,641 | B2 | 6/2018 | Bruckbauer | |
| 2007/0023420 | A1 * | 2/2007 | Gagas | H05B 6/1263 219/623 |
| 2012/0247345 | A1 * | 10/2012 | Chiang | F24C 15/2057 99/357 |
| 2014/0048057 | A1 | 2/2014 | Bruckbauer | |
| 2018/0335217 | A1 | 11/2018 | Bruckbauer | |

FOREIGN PATENT DOCUMENTS

| | | | |
|---|---|---|---|
| CN | 201351954 | Y | 11/2009 |
| CN | 201387055 | Y | 1/2010 |
| CN | 103688111 | A | 3/2014 |
| CN | 205094201 | U | 3/2016 |
| DE | 27 00 332 | A1 | 7/1977 |
| DE | 20 2006 016 179 | U1 | 3/2008 |
| DE | 10 2007 002 241 | A1 | 7/2008 |
| DE | 20 2009 008286 | U1 | 9/2009 |

(Continued)

*Primary Examiner* — David J Laux
(74) *Attorney, Agent, or Firm* — McGlew and Tuttle, P.C.

(57) ABSTRACT

An insert for a downdraft extractor includes a removable filter element for filtering a stream of cooking fumes, and a removable collecting element for receiving liquids. The collecting element has at least one wall which serves as a flow directing surface for deflecting the stream of cooking fumes.

19 Claims, 12 Drawing Sheets

(56) References Cited

FOREIGN PATENT DOCUMENTS

| | | | | |
|---|---|---|---|---|
| DE | 20 2011 005698 | U1 | 9/2011 | |
| DE | 10 2012 207 850 | A1 | 11/2013 | |
| DE | 20 2013 010 646 | U1 | 2/2014 | |
| DE | 10 2013 007 722 | A1 | 11/2014 | |
| EP | 1705430 | A1 * | 9/2006 | ..... F24C 15/2035 |
| EP | 2 702 329 | B1 | 7/2015 | |
| WO | 2012/146 237 | A1 | 11/2012 | |

* cited by examiner

INSERT FOR A DOWNDRAFT EXTRACTOR

CROSS REFERENCE TO RELATED APPLICATIONS

This application is a United States National Phase Application of International Application PCT/EP2017/065410 filed Jun. 22, 2017 and claims the benefit of priority under 35 U.S.C. § 119 of German patent application serial number DE 10 2016 211 206.6 filed Jun. 22, 2016, the entire contents of which are incorporated herein by reference.

FIELD OF THE INVENTION

The invention relates to an insert for a downdraft extractor. The invention furthermore relates to a downdraft extractor with an insert of this type. Finally, the invention relates to a hob system with a downdraft extractor of this type.

BACKGROUND OF THE INVENTION

DE 10 2007 002 241 A1 discloses a fume extractor system by means of which cooking fumes are extracted downward. Systems of this type are also referred to as downdraft extractors or downdraft systems.

DE 20 2013 010 646 U1 discloses a grease filter insert.

There is a constant need to improve downdraft extractors, in particular in respect of the degree of grease removal and/or their cleaning.

SUMMARY OF THE INVENTION

This object is achieved by an insert for a downdraft extractor, comprising a filter element for filtering a stream of cooking fumes, and a collecting element for receiving liquids, wherein the filter element and the collecting element are designed so as to be able to be joined together, wherein the collecting element has at least one wall which serves as a flow conducting surface for deflecting the stream of cooking fumes, and wherein the wall serving as the flow conducting surface of the collecting element is of curved and/or oblique design at least in regions, and by a downdraft extractor with a corresponding insert.

The essence of the invention consists in designing the insert with a removable filter element and a removable collecting element for receiving liquid, wherein the collecting element has at least one wall which serves as a flow directing surface for deflecting a stream of cooking fumes.

The filter element and the collecting element are designed in particular so as to be able to be joined together. This is not absolutely necessary. The filter element and the collecting element can also be formed as a single part. They are designed in particular in such a manner that, in the inserted state, they are arranged directly adjacent to each other, in particular lie against each other, in the housing of the downdraft extractor, in particular in the flow channel.

With such a design of the insert, a particularly high degree of removal of grease could be obtained, in particular as measured in accordance with DIN EN 61591.

In particular in the inserted state, the collecting element forms part of a flow channel for the stream of cooking fumes. It forms in particular part of a transition from one or more cooking-fume inlet openings to a channel for removing cooking fumes. The at least one inlet opening can be arranged in particular in the region of a hob plane. It can be in particular of round, in particular circular, or rectangular design.

The wall serving as the flow conducting surface of the collecting element leads in particular to a deflection of the stream of cooking fumes by approximately 90°, in particular by at least 10°, in particular by at least 30°, in particular by at least 45°, in particular by at least 60°. The deflection of the stream of cooking fumes by means of the wall serving as the flow directing surface of the collecting element can be defined here in particular by the angle which an outflow-side tangential plane onto the deflecting-outer side inner wall of the collecting element encloses with an inflow-side tangential plane onto the inner wall of the collecting element.

The channel for removing cooking fumes can be in particular a flat channel, in particular with an aspect ratio of width to height of the flat channel of at least 2:1, in particular at least 3:1, in particular at least 5:1. The aspect ratio is customarily smaller than 100:1, in particular smaller than 50:1.

The flat channel has in particular a flow cross section of at least 100 $cm^2$, in particular at least 150 $cm^2$, in particular at least 200 $cm^2$, in particular at least 250 $cm^2$, in particular at least 300 $cm^2$. The flow cross section is in particular at most 1000 $cm^2$.

The removability of the collecting element enables in particular the cleaning of the insert to be considerably facilitated.

By means of the design of the collecting element with at least one wall which serves as a flow directing surface for deflecting the stream of cooking fumes, in particular the fluidic properties of said collecting element are improved. This contributes to more efficient extraction of the cooking fumes and to a reduced production of noise.

The insert can be removable as a whole. The filter element and the collecting element can be in particular fixedly connected to each other. It is possible in particular to form the collecting element as a single part with the filter element.

According to one aspect of the invention, the filter element is removable separately from the collecting element. The filter element has in particular a handle, for example in the form of a recessed handle. The handle can also be arranged in a manner such that it can be unfolded or pulled out in a wall of the filter element.

According to a further aspect of the invention, the collecting element has a handle. The removability of the collecting element is thereby facilitated. The handle can be designed in a manner corresponding to the handle of the filter element.

According to a further aspect of the invention, the wall serving as the flow directing surface of the collecting element can be of arcuate or curved design.

It can also be of oblique design at least in sections. This should be understood as meaning that, in the inserted state of the collecting element, said wall is oriented, at least in sections, neither parallel to a vertical plane nor parallel to a horizontal plane. It has in particular at least one region which encloses an angle within the range of 30° to 60° with a vertical plane. In the case of a curved design, this detail refers to a tangential plane onto the inner side serving as the flow directing surface of the wall.

The wall can in particular also be of flat design in sections.

It is designed in particular in such a manner that, in the inserted state of the insert, the wall at least in regions, encloses an angle of at least 3°, in particular at least 5°, in particular at least 10°, with the horizontal.

It is designed in particular in such a manner that, in the inserted state of the insert in the region of a side wall, in particular on the inflow side, said wall, at least in regions, encloses an angle of at least 10° with the vertical. In the case of an arcuate design of the wall, said details relate to the orientation of a tangential plane with respect to said wall. This improves a deflection of the stream of cooking fumes.

The profile of the wall which serves as the flow directing surface can be describable essentially by a continuously differentiable function.

The wall is preferably of edge-free design. The wall is in particular an outer wall of the flow channel. The wall of the collecting element that serves as the flow directing surface for deflecting the stream of cooking fumes can merge in particular in a substantially edge-free manner into a wall of the filter element. The filter element and the collecting element can in particular be joined together in such a manner that a wall of the filter element and a wall of the collecting element form a substantially edge-free flow directing surface for deflecting the stream of cooking fumes.

Alternatively or additionally thereto, flow-guiding means, in particular in the form of one or more flow directing elements, can be arranged in the region of the wall serving as the flow directing surface for deflecting the stream of cooking fumes, in particular in the transition region from the filter element to the collecting element. Said flow-guiding means can also serve for producing targeted swirling of the stream of cooking fumes.

All of the walls of the filter element and of the collecting element that define the flow cross section of the insert are preferably formed in a corresponding manner.

The structural configuration of the housing of the downdraft extractor is simplified by the insert wall acting as the flow directing surface. The housing can be in particular of right angled design. Resulting flow losses, in particular in the corner regions of the housing, are avoided by means of the insert. By means of the insert, in particular the wall thereof serving as the flow directing surface, the formation of dead spaces in the housing of the downdraft extractor can be reliably prevented.

According to a further aspect of the invention, the collecting element and/or the filter element are/is designed in such a manner that they form a substantially edge-free continuation of a horizontal flow section in the region of the inner radius of the flow channel.

The effect which can be achieved in particular by means of the insert is that the flow channel does not having sharp-edged deflections, in particular sharp-edged 90° deflections. Sharp-edged refers here in particular to a deflection with a radius of curvature of less than 1 mm.

The effect which can be achieved in particular with the aid of the insert is that the effective flow region is substantially edge-free, apart from specially provided swirling means, and in particular is free of undesirable sharp-edged deflecting regions.

According to one aspect of the invention, the insert is designed in particular in such a manner that the regions thereof which serve as flow directing surfaces for the stream of cooking fumes, in particular the walls of the collecting element that serve as flow directing surfaces for deflecting the stream of cooking fumes, have a radius of curvature of at least 1 cm, in particular at least 2 cm.

According to one aspect of the invention, the collecting element is of substantially edge-free design, in particular is designed to be free of dead space. The entire insert is preferably designed to be substantially free of dead space. It has in particular a flow-optimized design.

According to a further aspect of the invention, the filter element and/or the collecting element are/is of self-centering design. This should be understood as meaning that said filter element or collecting element automatically slides into the designated end position upon insertion into the downdraft extractor. This can be achieved, for example, with the aid of guide means on the outer side of the collecting element and/or of the filter element, said guide means interacting with suitable guide means in the housing of the downdraft extractor, in particular on the inner side of the opening for the insertion of the insert. The guide means can be designed in the form of grooves, projections, guide slots and the like.

In addition, a self-centering design of the filter element and/or of the collecting element can be assisted by a suitable arrangement of the respective mass center of gravity of said elements. In particular by means of the relative position of the mass center of gravity with respect to the handle element or the handle elements of the filter element and/or of the collecting element, the orientation of said elements can be influenced upon insertion into the downdraft extractor.

In addition, the filter element and the collecting element are designed in such a manner that, upon insertion into the downdraft extractor, they automatically slide into the designated joined-together relative position of said two elements with respect to each other. Suitable guide means can also be provided for this purpose on the filter element and/or on the collecting element. The guide means on the filter element and/or on the collecting element are designed in particular in a complementary manner with respect to one another, in particular so as to intermesh. They are in particular mechanical guide means Taking up of the designated relative position of the filter element and of the collecting element can also be assisted by alternative guide means, for example by magnetic guide means.

According to one alternative, the exact relative position of the filter element and of the collecting element in the inserted state is predetermined exclusively by the interaction thereof with the housing of the downdraft extractor. Upon insertion into the downdraft extractor, they slide in particular into the designated positions. They lie against one another in the inserted state. They lie against one another in particular in a form-locking manner in the inserted state. In particular in the region in which they lie against one another in the inserted state, they have a substantially identical inner border and/or a substantially identical outer border.

According to a further aspect of the invention, the filter element and/or the collecting element are/is of a symmetrical design. Said element has in particular specifically asymmetrical guide means. Apart from said guide means, the filter element and/or the collecting element can be of substantially symmetrical design with respect to a center plane.

By means of the asymmetrical design of the filter element and/or of the collecting element, it can be ensured that the respective element cannot be rotated by 180° but rather can be inserted into the downdraft extractor exclusively with the correct designated orientation.

According to a further aspect of the invention, the filter element is of two-part or multi-part design. It has in particular a frame and one or more filter layers arranged thereon. The frame is preferably composed of plastic. It can also be composed of metal, in particular of aluminum or stainless steel. It is preferably composed of a corrosion-resistant, moisture-insensitive and heat-resistant material.

The filter layers are preferably composed of stainless steel. They can be formed in particular as double layers from a stainless steel knitted fabric. In particular, one, two, three, four, five, six, seven, eight or more such double layers can be provided. The filter layers in particular have an arcuate design. By this means, the overall surface of the filter that can be arranged in the available width of the filter element is increased.

The curvature of the filter layers has a radius of curvature of less than 100 cm, in particular less than 50 cm, in particular less than 30 cm, in particular less than 20 cm.

Different filter layers can have different radii of curvature. The filter layers can be arranged in particular concentrically. The upper filter layers here can have a smaller radius of curvature than the lower filter layers. The filter layers can cover identical angular regions. In other words, they can have different extents in the circumferential direction.

In the state of the filter element inserted correctly into the downdraft extractor, the filter layers are designed so as to be curved in particular about a horizontally oriented axis.

The filter element is preferably designed to be dishwasher safe. The cleaning thereof is thereby considerably simplified.

According to a further aspect of the invention, the collecting element is formed at least in regions, in particular completely, from plastic. This leads to a particularly low weight of the collecting element. The collecting element is in particular moisture- and heat-resistant. It is designed in particular to be dishwasher safe.

In the region on the flow-output side, the collecting element has a cooking-fume outlet opening. The latter is followed in the inserted state of the insert by a cooking-fume removal channel. The transition from the collecting element to the cooking-fume removal channel is preferably of substantially edge-free design. The transition has in particular such a flow-optimized shape that swirling of the stream of cooking fumes is reduced, in particular very substantially avoided, in this region.

According to one alternative, the collecting element has a separation edge at the transition to the cooking-fume removal channel, in particular in the region of the cooking-fume outlet opening. The separation edge serves in particular for producing specific swirling of the stream of cooking fumes in said region. The effect which can be achieved by this is that liquid and/or dirt collected in the collecting element are not drawn into the removal channel by the stream of cooking fumes, but rather collect in the collecting trough of the flow channel. They can easily be removed from there.

According to a further aspect of the invention, the collecting element is designed as a collecting trough or comprises at least one corresponding trough or at least one trough-shaped region. The collecting element, in particular the collecting trough, has a collecting volume of at least 50 ml, in particular at least 100 ml, in particular at least 200 ml, in particular at least 300 ml, in particular at least 500 ml, in particular at least 700 ml. The collecting volume is customarily smaller than 200 ml, in particular smaller than 1000 ml.

According to a further aspect of the invention, the collecting element forms a transition piece between the filter element and the channel, adjoining the outflow side, for removing the stream of cooking fumes. The transition from the filter element to the collecting element is in particular of substantially edge-free design.

According to a further aspect of the invention, the collecting trough can have a cover which is liquid-permeable at least in regions. The cover can serve here in particular as a flow directing element. The flow of the stream of cooking fumes through the collecting element can be further improved with the aid of the cover. In order to achieve the liquid permeability, openings, for example, in particular bores or slots, can be provided in the cover.

According to a further aspect of the invention, at least one signal-emitting element is provided on the filter element and/or on the collecting element. This can be a mechanical, electrical or magnetic signal-emitting element. The at least one signal-emitting element interacts with a receiving device matched thereto in the downdraft extractor. This permits identification, by means of which a signal can be generated depending on whether the insert or the components thereof are correctly inserted into the downdraft extractor or not. Said signal can be transmitted via a signal connection to a control device of the downdraft extractor. This makes it possible to design the controller of the downdraft extractor in such a manner that the downdraft extractor is capable of functioning only when an insert is inserted correctly or only when a collecting element is inserted correctly and/or a filter element is inserted correctly. Alternatively or additionally thereto, it can also be provided to output a signal, in particular an optical or acoustic signal, in the event of a filter element and/or collecting element not being correctly inserted.

According to a further aspect of the invention, one or more sensors can be provided in the collecting element and/or in the filter element. With the aid of sensors of this type, the operating state of said elements can be monitored. With the aid of a sensor in the collecting element, in particular the quantity of liquid in the collecting element or exceeding of a predetermined quantity of liquid in the collecting element can be detected. With the aid of a sensor in the filter element, the loading state thereof or the remaining capacity thereof can be detected, and therefore it can be identified when the filter should be cleaned.

The advantages of the downdraft extractor with the insert described above are apparent from the advantages of the insert.

The downdraft extractor has in particular an improved possibility of cleaning. It also in particular has improved fluidic properties.

It leads overall to an improvement of a hob system. The hob system can be in particular a mounting unit. In the case of a mounting unit of this type, the hobs and the downdraft extractor are integrated in a single common installation unit. The mounting unit has in particular a particularly compact construction. It has in particular an overall installation height within the range of less than 30 cm, in particular less than 25 cm, in particular less than 20 cm, in particular less than 18 cm, in particular less than 16 cm, in particular less than 15 cm.

The mounting unit can be supplied finished and assembled. It is insertable into a recess in a worktop. The base cabinet provided in the region of the mounting unit preferably does not have to be modified here. It suffices merely to remove an uppermost drawer and replace the latter by a screen.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

The general components of a hob system 1 will first of all be described below. The hob system 1 comprises at least one hob 2. In the hob system 1 illustrated by way of example in FIG. 1, two hobs 2 are provided. The hobs 2 can be essentially any desired hobs. They can be in particular induction hobs, gas hobs, Teppan Yaki hobs, hobs for a wok, electric hobs or hotplates, grills or other hobs.

Figure 1:
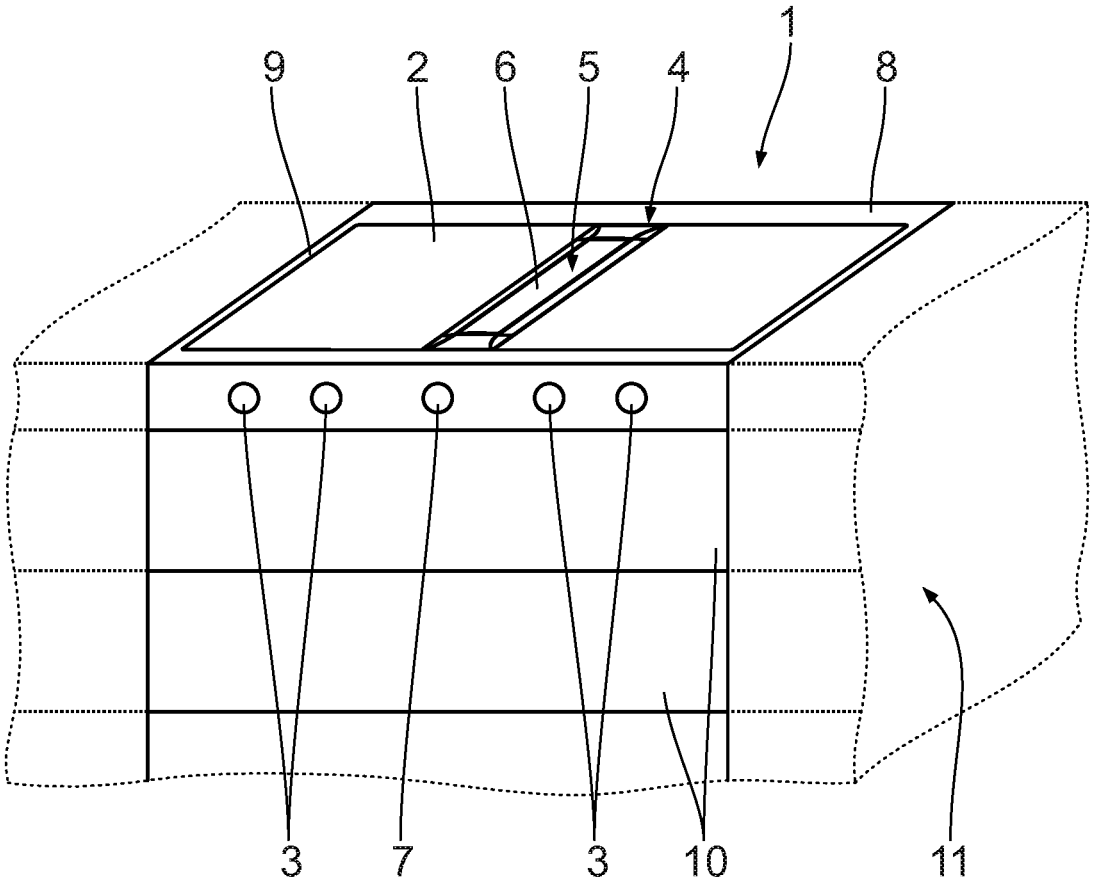
FIG. 1 is a schematic view of a hob system with two hobs and a downdraft extractor arranged inbetween.

In the case of the alternative illustrated by way of example in FIG. 1, operating knobs 3 are in each case provided for operating the hobs 2. Operation by means of touch-sensitive sensors which can in particular be integrated in the hobs 2 is also possible. Operation via a separate operating module is also conceivable. In this case, the hobs 2 can be designed to be non-autonomous, i.e. without dedicated electronic controller. The construction of the hobs 2 can thereby be simplified. It is possible in particular to reduce the overall height of the hobs 2. They can be in particular at most 10 cm, in particular at most 6 cm, in particular at most 5 cm, in particular at most 4 cm, in particular at most 3 cm, in particular at most 2 cm.

Furthermore, the hob system 1 comprises a downdraft extractor 4. The downdraft extractor 4 forms an apparatus for extracting cooking fumes.

Figure 2:
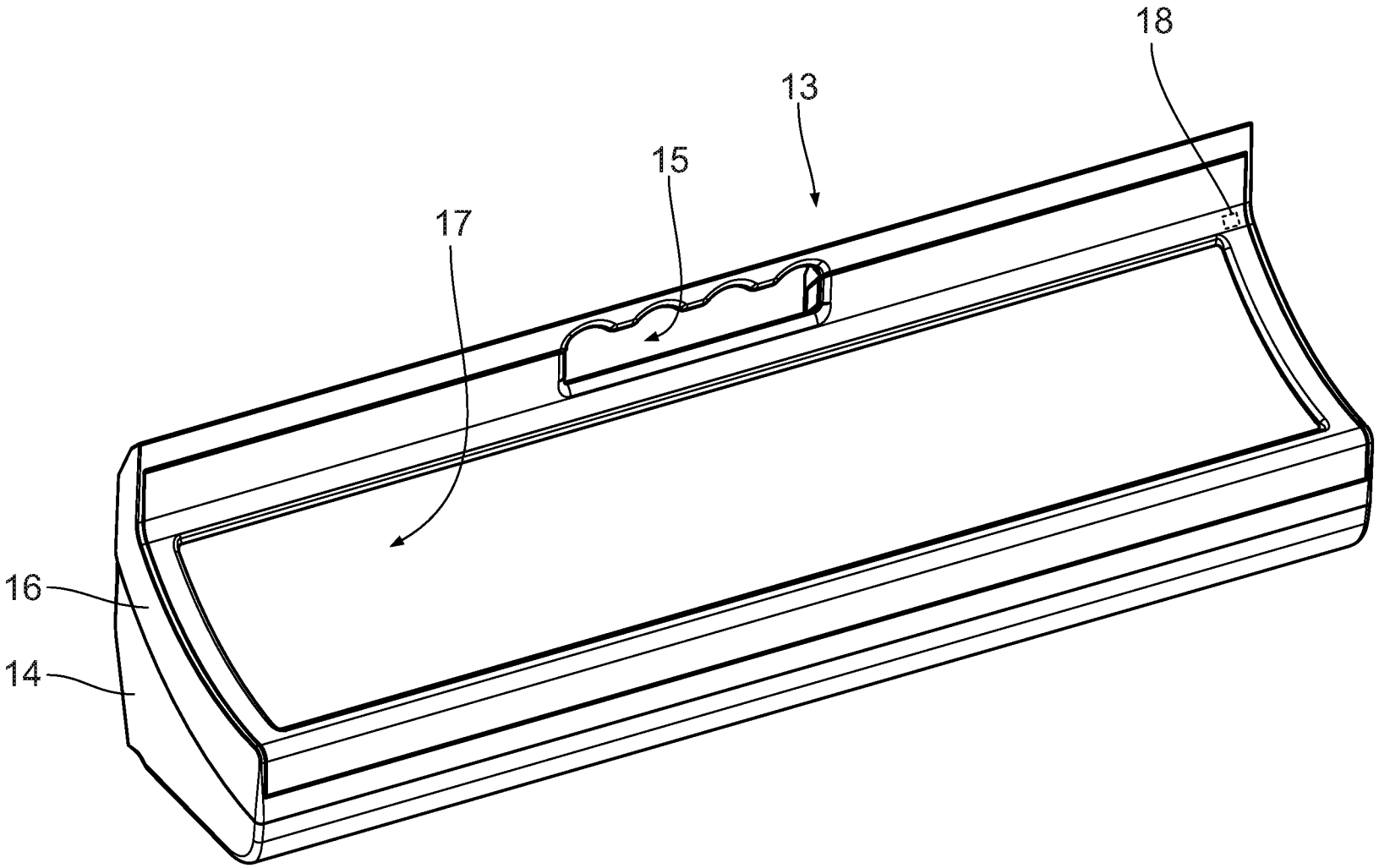
FIG. 2 is a perspective view of an insert for a downdraft extractor.

In the case of the alternative illustrated in FIG. 2, the downdraft extractor 4 is arranged between the two hobs 2. It can also be arranged to the side of the hobs 2 or in the region behind the hobs 2.

It can have a round, in particular a circular, cooking-fume inlet opening 5. In the alternative illustrated, the cooking-fume inlet opening 5 is of elongate, in particular rectangular, design. The cooking-fume inlet opening 5 has in particular an aspect ratio of at least 2:1, in particular at least 3:1, in particular at least 5:1, in particular at least 10:1. The aspect ratio of the cooking-fume inlet opening 5 is customarily at most 100:1, in particular at most 50:1.

A plurality of cooking-fume inlet openings 5 can also be provided. It is possible in particular to provide two or more cooking-fume inlet openings 5, in particular slot-shaped cooking-fume inlet openings 5. They can be oriented in particular parallel to one another.

The cooking-fume inlet opening 5 is reversibly closeable in particular by means of a closure element 6. In the case of a plurality of cooking-fume inlet openings 5, the latter can each be reversibly closeable separately, i.e. independently of one another, by means of closure elements 6.

An operating knob 7 is provided for operating the downdraft extractor 4. Operation by means of a touch-sensitive sensor is likewise possible.

The downdraft extractor 4 is arranged in particular in the region of a hob plane 8. It serves for extracting cooking fumes from the region above the hob plane 8 into a region below the hob plane 8. It is therefore also referred to as a downdraft system (extraction downward).

The cooking-fume inlet opening 5 is preferably arranged in a fixed position relative to the hob plane 8.

According to an alternative which is not illustrated in the figures, the region of the downdraft extractor 4 with the cooking-fume inlet opening 5 can be shifted in a direction perpendicular to the hob plane 8.

It can be provided to arrange the cooking-fume inlet opening 5 a few millimeters above the hob plane 8. By this means, the risk of unwanted penetration of liquid into the downdraft extractor 4, in particular in the event of boiling over of liquids, can be considerably reduced. It can in particular also be provided to design the cooking-fume inlet opening 5 in such a manner that it can be designed to be shiftable into a position a few millimeters above the hob plane during the operation of the downdraft extractor 4. In this case, it can be arranged aligned with the hob plane 8 in the switched-off state of the downdraft extractor 4.

The hob system 1 is of modular design. In this case, substantially freely selectable hobs 2 can be combined flexibly with one or more of the downdraft extractors 4.

The hob system 1 can also be designed as a mounting unit. In this case, one or more hobs 2 are integrated with one or more downdraft extractors 4 into a single system. They are arranged in particular in a common housing. The latter merely has to be inserted into a recess in a worktop 9 for mounting purposes.

In the region below the hob system 1, compartments, in particular drawers 10 of a kitchen base cabinet 11, can be used substantially without restriction.

The kitchen base cabinet 11 forms an item of kitchen furniture in general. The hob system 1, in particular the downdraft extractor 4, can be integrated in the item of kitchen furniture. It can be integrated into the item of kitchen furniture in particular at the factory.

The mounting unit, in particular the downdraft extractor 4, preferably has an overall height h within the range of less than 30 cm, in particular less than 25 cm, in particular less than 20 cm, in particular less than 18 cm, in particular less than 16 cm, in particular less than 15 cm. The mounting unit in particular requires no more space below the worktop 9 for installation than a normal cutlery drawer.

For corresponding details and further details regarding the general construction of the hob system 1, reference should be made to EP 2 702 329 A1 and corresponding U.S. publications, US 2014/0048057 A1 and US 2018/0335217 A1, and corresponding U.S. patent, U.S. Pat. No. 10,006,641 B2. The contents of each of EP 2 702 329 A1, US 2014/0048057 A1, US2018/0335217 A1 and U.S. Pat. No. 10,006,641 B2 are incorporated herein by reference.

Figure 3:
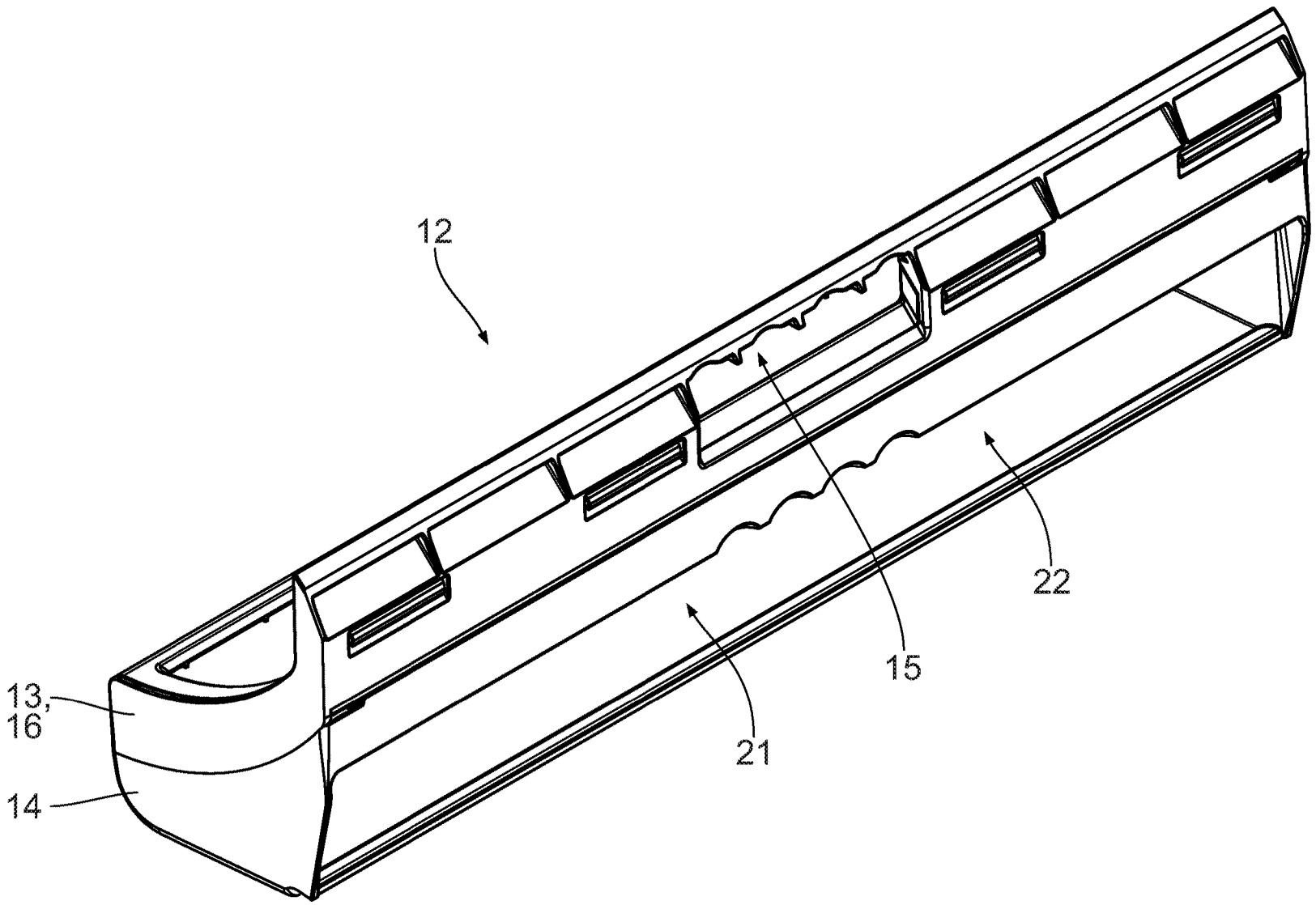
FIG. 3 is a perspective view of the insert according to FIG. 2 from a different viewing angle.
Figure 4:
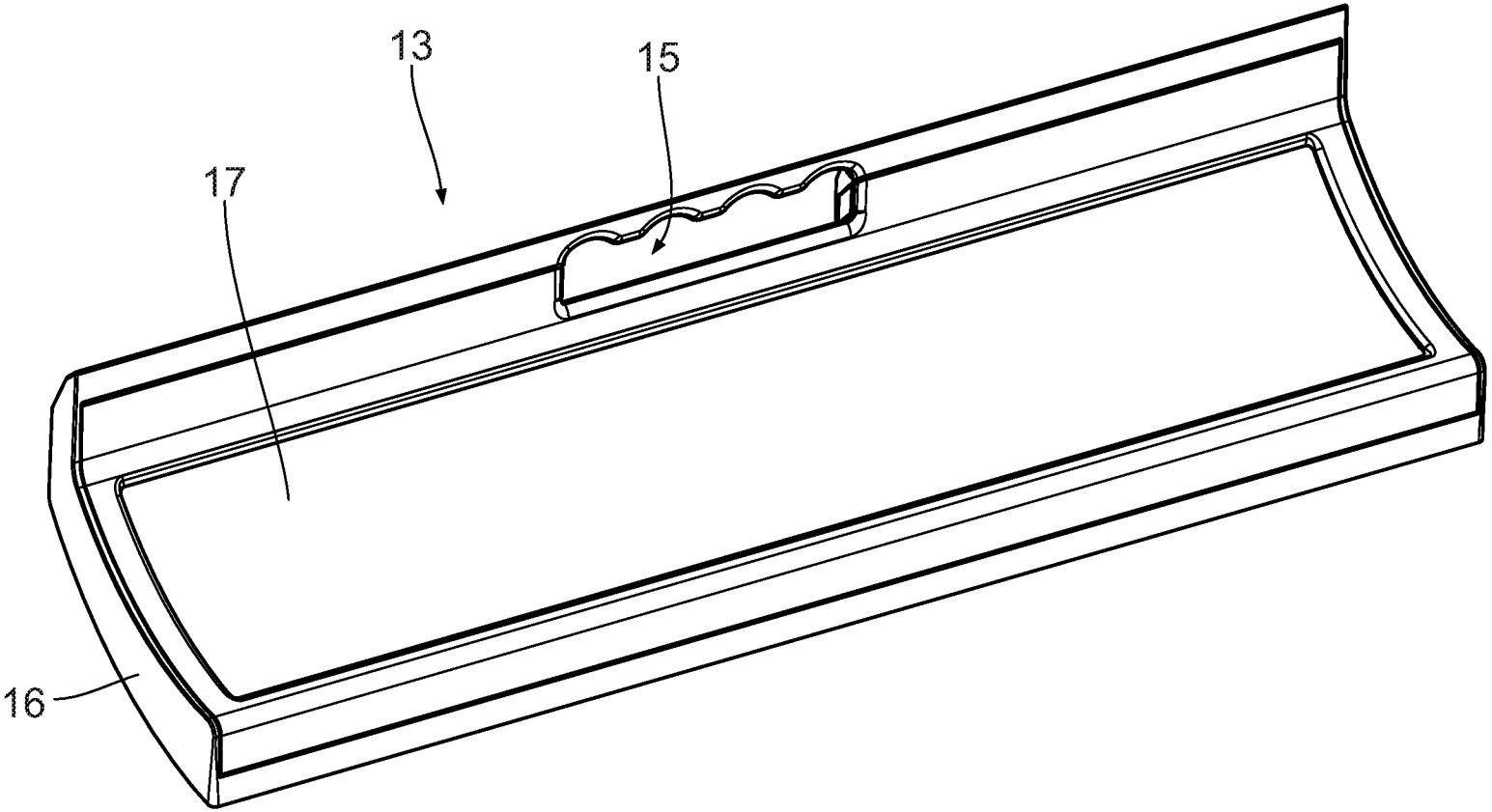
FIG. 4 is a view of the filter element of the insert according to FIG. 2.

Further features of the downdraft extractor 4, in particular of a cooking-fume inlet device 41 thereof, will be described below with reference to FIGS. 2 to 4. FIGS. 7 to 11 in particular each only illustrate a section of the downdraft extractor 4 from the region of the cooking-fume inlet device 41. Components of the downdraft extractor 4 that follow downstream in the direction of flow 27 are not illustrated in these figures for the sake of clarity.

Figure 5:
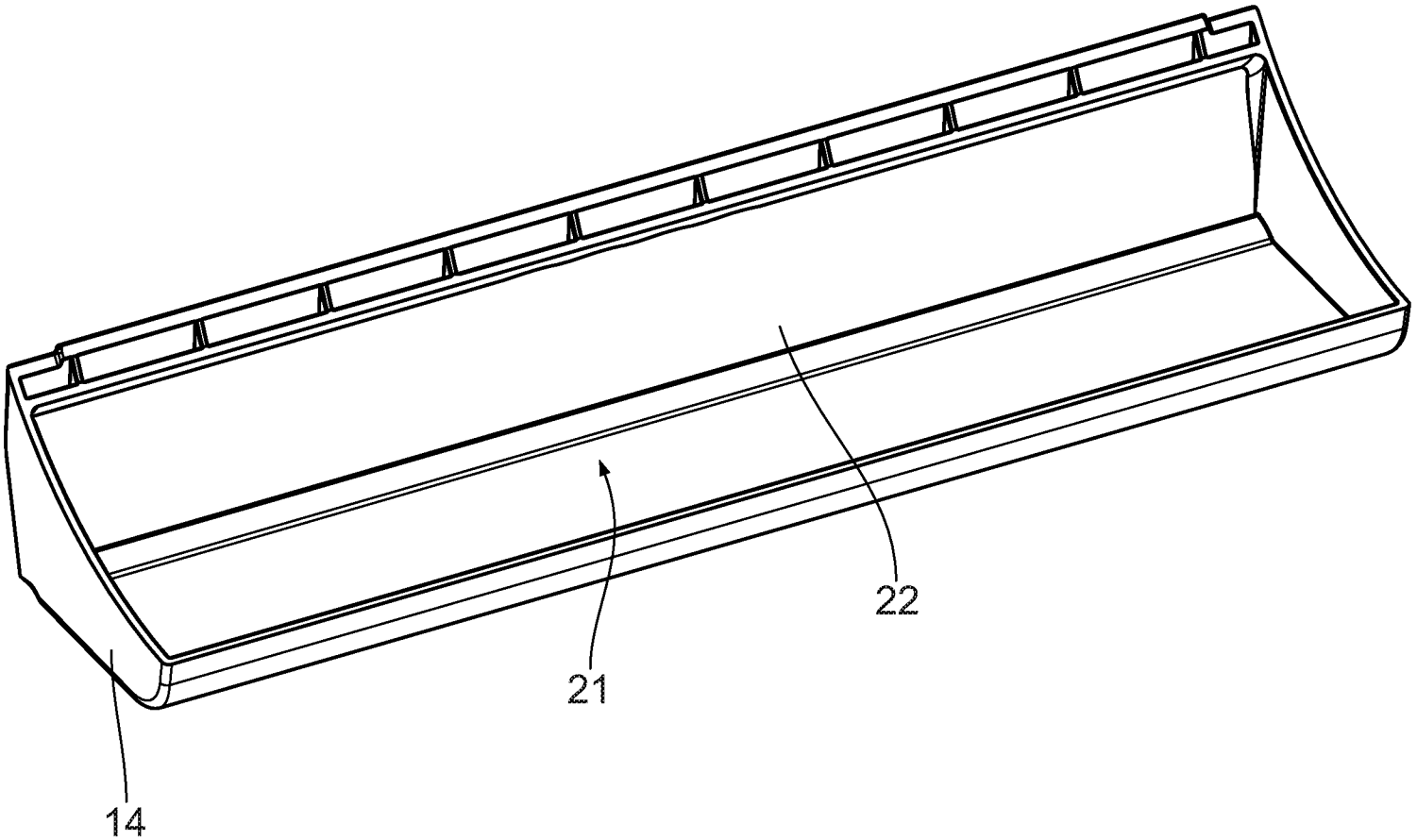
FIG. 5 is a view of the collecting element of the insert according to FIG. 2.
Figure 6:
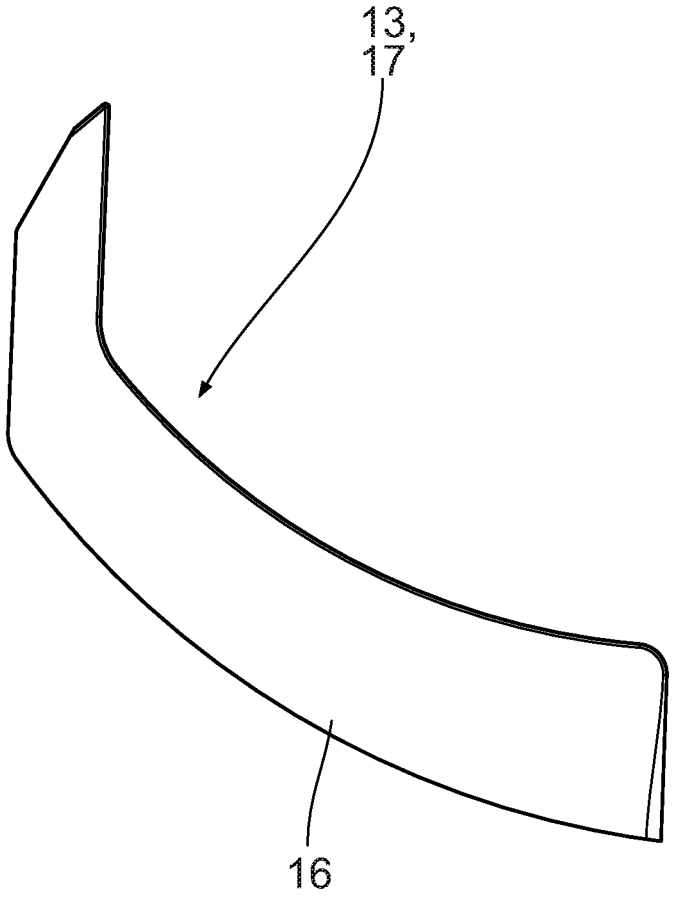
FIG. 6 is a side view of the filter element according to FIG. 4.
Figure 7:
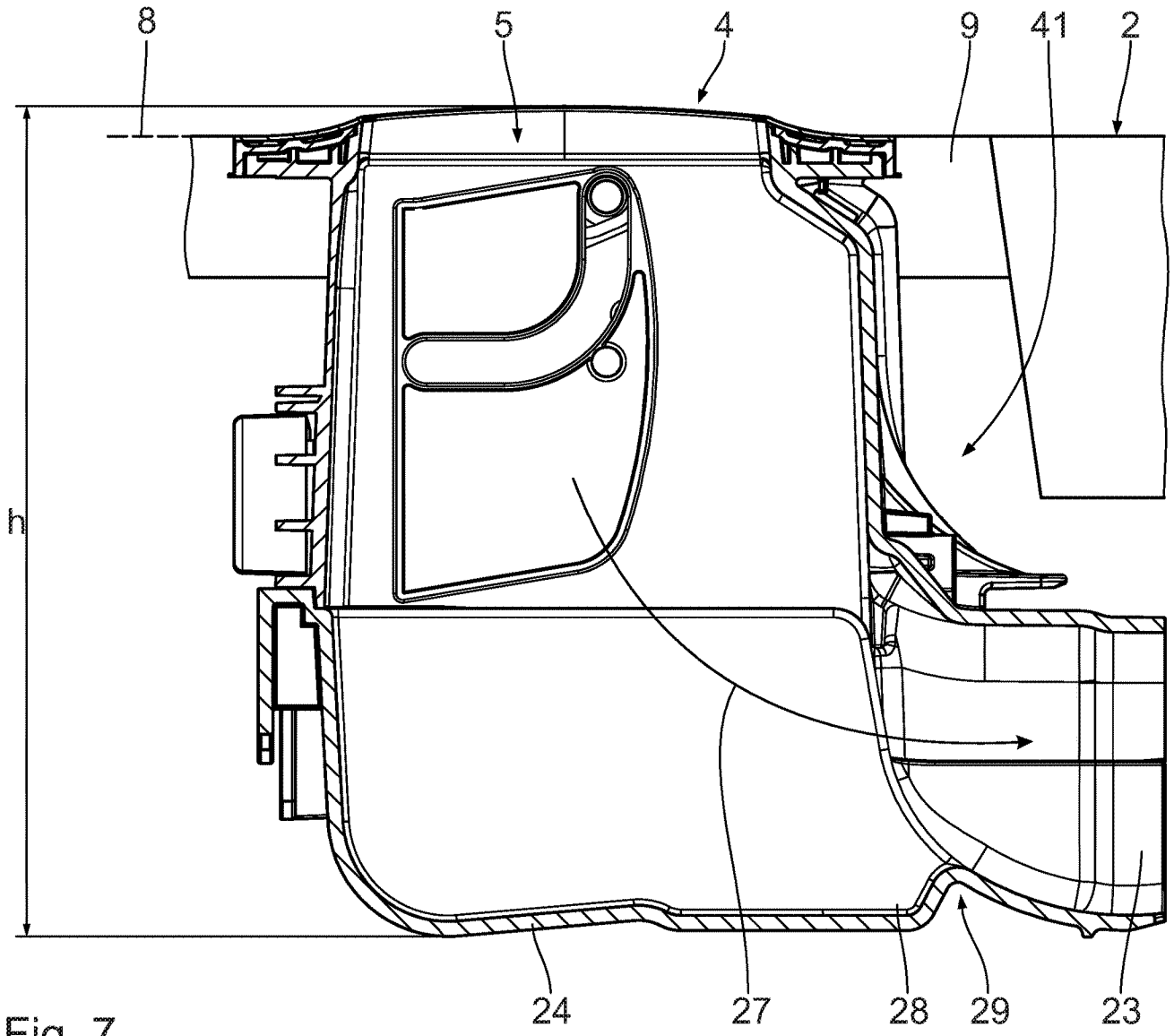
FIG. 7 is a schematic sectional view through a section of a hob system in the region of a downdraft extractor, with the collecting element of the insert having been removed.
Figure 8:
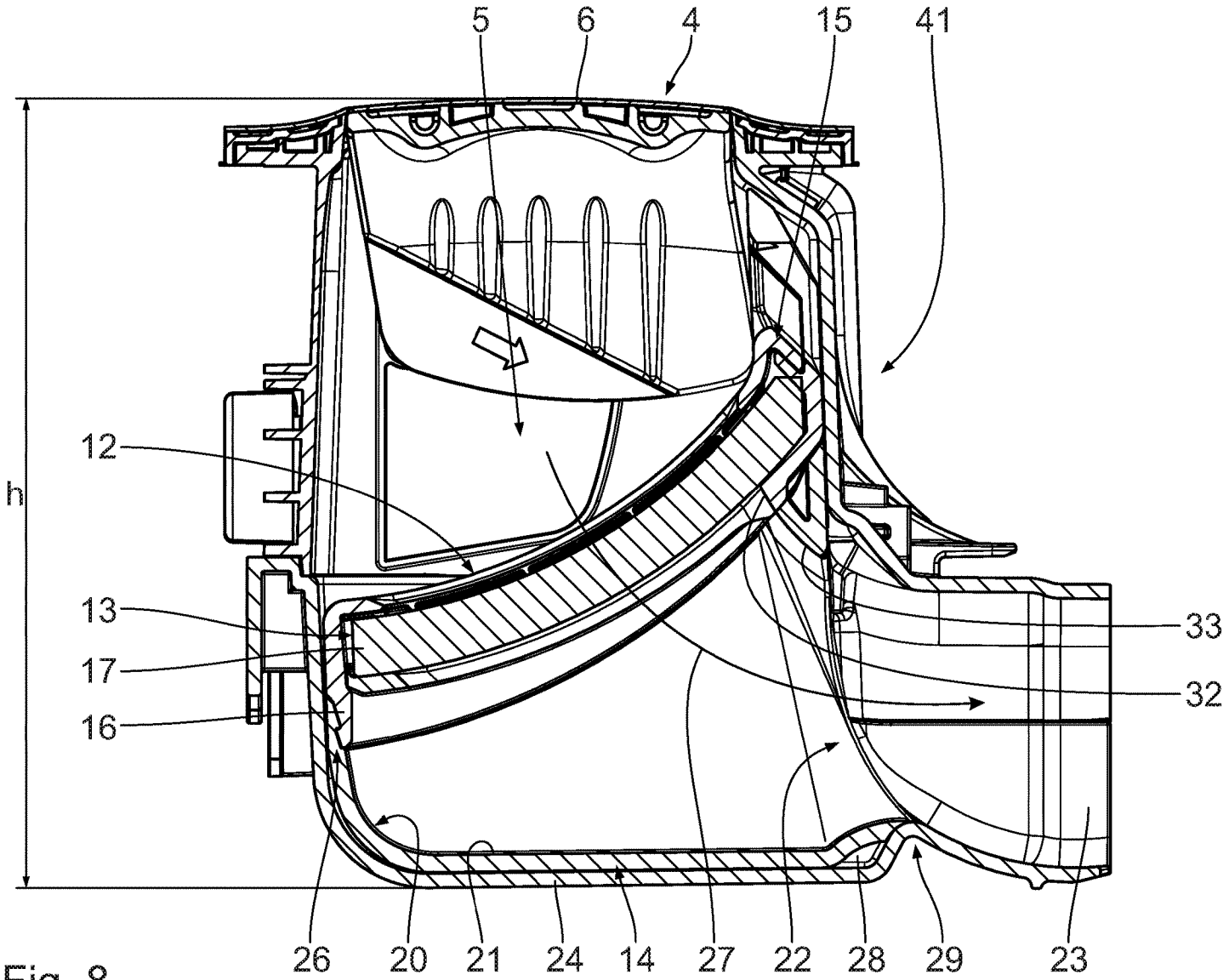
FIG. 8 is a view according to FIG. 7 with an insert inserted into the downdraft extractor.

The downdraft extractor 4 comprises an insert 12. An alternative of the insert 12 is illustrated by way of example in FIGS. 2 and 3. The insert 12 is of multi-part design. It comprises a filter element 13 and a collecting element 14. The filter element 13 and the collecting element 14 can be separated from each other. FIG. 4 illustrates the filter element 13 without the collecting element 14. In FIG. 5, the collecting element 14 is illustrated without the filter element 13.

The filter element 13 is removable from the downdraft extractor 4. It is removable from the downdraft extractor 4 in particular independently of the collecting element 14.

To simplify the removability, the filter element 13 has a handle 15. The handle 15 can be designed in the form of a recess handle. It is in particular of ergonomically advantageous design, and in particular is adapted to the customary size of fingers of a human hand.

The filter element for its part is of two-part design. It has a frame 16. The frame 16 is of dimensionally stable design. It can be composed in particular of plastic. According to an alternative, the frame 16 is formed from metal, in particular from aluminum or stainless steel. Other materials, for example carbon, are likewise possible. The frame 16 is composed in particular of a moisture- and heat-resistant material.

In addition, the filter element 13 comprises the actual filter 17. The filter 17 comprises a plurality of layers composed of a filter fabric. The filter layers are preferably composed of stainless steel. The filter 17 can in particular have a plurality of layers, in particular at least three, in particular at least five, in particular eight or more layers, in particular double layers. The layers can comprise a stainless steel knitted fabric. They can be composed in particular of a knitted fabric grid on both sides.

The filter 17 is in particular a grease filter.

The downdraft extractor 4, in particular the system comprising the removable parts of the downdraft extractor 4, in particular the system comprising the filter 17, the collecting element 14 and an optionally present collecting trough 28, has a degree of grease removal of more than 45%, in particular more than 55%, in particular more than 65%, in particular more than 75%, in particular more than 85%, in particular more than 95%. This detail refers to the degree of grease removal in accordance with DIN EN 61591.

The filter 17, in particular the filter layers, is/are of arcuate design. The filter layers are of arcuate design in particular relative to a horizontally oriented axis. They have a rectilinear profile in particular in a horizontal section.

A flow-optimized design of the filter element 13 can be achieved by an arcuate shape.

The filter element 13 is dishwasher safe. For cleaning purposes, it can simply be removed from the downdraft extractor 4 and placed into the dishwasher.

A signal emitter 18 is arranged on the frame 16. A magnet serves as the signal emitter 18. As an alternative thereto, the signal emitter 18 can also be designed, for example, as an electrical contact or mechanically, for example as a projection, in particular in the form of a latching lug.

Via a suitable sensor element in the downdraft extractor 4, it can be detected with the aid of the signal emitter 18 whether the filter element 13 is or is not inserted correctly in the downdraft extractor 4. The corresponding sensor is preferably in signal-transmitting connection with a control device (not illustrated in the figures) for the downdraft extractor 4.

The collecting element 14 is likewise removable from the downdraft extractor 4. For this purpose, the collecting element 14 has a handle 19. With regard to the design thereof, reference should be made to the description of the handle 15 of the filter element 13.

The collecting element 14 is designed to match the filter element 13. The two elements 13, 14 can be plugged or placed into each other or against each other in particular in a form-locking manner. In the plugged-together state or state lying against each other, they have in particular an inner wall 20 which is of substantially edge-free design. The inner wall 20 is of arcuate design. It forms a flow directing surface for deflecting the stream of cooking fumes. The flow directing surface is of substantially edge-free, preferably smooth design. The profile of the flow directing surface, in particular the cross section thereof relative to a vertical plane, in particular relative to a vertically oriented central plane of the downdraft extractor 4, are described in particular by a continuous function, in particular a differential function, in particular by a continuously differentiable function. The flow directing surface can have a constant curvature. The flow directing surface can also have a curvature varying in the direction of flow. It can be of substantially flat design in particular in an edge region facing the cooking-fume inlet opening 5. It can be of substantially flat design in particular in an edge region facing the cooking-fume outlet opening 22. In this case, it is of arcuate design only in the region between said edge regions.

The collecting element 14 serves for receiving liquids. For this purpose, it has a collecting trough 21 or at least one trough-like region. The collecting trough 21 has a collecting volume of at least 50 ml, in particular at least 100 ml, in particular at least 200 ml, in particular at least 300 ml, in particular at least 500 ml, in particular at least 700 ml.

The collecting element 14 is composed of a dimensionally stable material. The collecting element 14 is in particular composed of plastic. It can also be composed of metal, in particular of aluminum, or stainless steel. The collecting element 14 can also be produced from other materials, for example from carbon, or can comprise materials of this type.

The collecting element 14 is produced in particular exclusively from moisture-resistant materials. It is heat-resistant in particular to temperatures to up to 75° C., in particular to up to 80° C., in particular to up to 95° C., in particular at least 100° C.

The collecting element 14 has a cooking-fume outlet opening 22. The cooking-fume outlet opening 22 is adjoined in the state of the collecting element 14 inserted into the downdraft extractor 4 by a channel 23 for removing cooking fumes. The transition from the collecting element 14 to the channel 23 is in particular of substantially edge-free design. It is preferably of flow-optimized design in such a manner that, apart from specific dead space and/or swirling regions, a substantially swirl-free flow of cooking fumes is permitted. In the direction of flow downstream of the grease filter 17, the throughflow cross section can initially be increased. After a deflection, the flow cross section is reduced in an adjoining region. By means of a rounded design of the inner wall and/or outer wall bounding the flow region, in particular in the region of the deflection, and in particular by avoiding buckling points in said region, the fluidic properties of the downdraft extractor 4, in particular of the insert 12, were able to be improved. It was possible in particular to reduce flow losses.

In the inserted state, the collecting element 14 lies against a bottom wall 24 of the downdraft extractor 4, in particular of the channel 23 for removing the cooking fumes. The collecting element 14 is removable upward, in particular vertically upward, in particular after the filter element 13 has been removed from the downdraft extractor 4.

The collecting element 14 has a flow-optimized shape. It is of substantially edge-free design in particular on its inner side facing the flow region.

The collecting element 14, in particular the collecting trough 21, can rest in a flush manner in a collecting trough 28 in the channel 23. It lies in particular flush at least in regions on the collecting trough 28. By this means, an air flow can be avoided in the region between the collecting trough 21 of the filter element 13 and the collecting trough 28 in the channel 23.

The collecting element 14 is designed in such a manner that the position of its mass center of gravity 25 relative to the handle 19 promotes, in particular brings about, a pivoting of the collecting element 14 about a horizontally running axis, said pivoting simplifying the insertion of the collecting element 14 into the downdraft extractor 4. The mass center of gravity 25 of the collecting element 14 is arranged relative to the handle 19 in particular in such a manner that the horizontal extent of the collecting element 14, when the latter is suspended on the handle 19, is reduced, in particular minimized, in comparison to the maximum horizontal extent in the correctly inserted state. When the collecting element 14 is removed by way of the handle 19, the collecting element 14 is automatically pivoted. The removability of the collecting element 14 can thereby be facilitated.

The collecting element 14 can be provided with guide means which lead to a self-centering design of the collecting element 14 upon insertion into the downdraft extractor. For example, one or more grooves, webs, projections, bulges or recesses can serve as the guide means.

The filter element 13 and the collecting element 14 can in particular be plugged together. For this purpose, they have mutually adapted connecting means 26 in the form of projections or recesses. This is not absolutely necessary. Special connecting means can also be dispensed with. The filter element 13 and the collecting element 14 can be, but do not have to be, latchable to each other. In the inserted state, they can also lie loosely against each other. In the state lying loosely against each other, in particular in the plugged-together state, the filter element 13 and the collecting element 14 form a substantially edge-free, continuous, in particular smooth surface.

The collecting element 14 and the filter element 13 are preferably designed in such a manner that they are automatically brought together into the correct relative positioning upon insertion into the downdraft extractor 4. For this purpose, guide means, in particular in the form of recesses, in particular guide grooves and projections interacting therewith, can be provided on the outer walls of the filter element 13 and of the collecting element 14 or on the inner side of the downdraft extractor 4.

The collecting element 14 is arranged downstream with respect to the filter element 13 in the direction of flow 27 of the stream of cooking fumes in the downdraft extractor 4. Emerging liquids and grease can therefore be collected in the collecting element 14 downstream of the filter element 13 in the direction of flow 27.

A collecting trough 28, in particular for collecting liquids, is preferably formed in the channel 23 for removing the cooking fumes themselves. For this purpose, a liquid barrier in the form of an upwardly protruding lug 29 is formed in the channel 23. In the state of the collecting element 14 inserted into the downdraft extractor 4, the collecting trough 21 or the lower edge of the cooking-fume outlet opening 22 lies substantially flush against the lug 29.

The collecting trough 28 can be designed to be removable or so as to be able to be taken out. It can be latchable in particular to the channel 23, in particular to the remainder of the channel 23. It is attachable to or in the channel 23 in particular in such a manner that said channel is sealed to the outside in a liquid-tight manner by the collecting trough 28.

The collecting trough 28 can remain in the extraction guide even when the collecting element 14 together with the collecting trough 21 is removed from the downdraft extractor 4. The collecting trough 28, which is also referred to as a maintenance trough, is customarily removed only for maintenance work to the downdraft extractor 4 or in the event of heavy soiling.

In the inserted state, the insert 12 forms part of a channel for deflecting and removing the stream of cooking fumes. In other words, the insert 12 has in particular a flow-directing function. Expressed in another way, the inner wall 20 serves as a flow directing surface for the stream of cooking fumes. By means of the design thereof, in particular by means of the curved, substantially edge-free design, the flow of cooking fumes is substantially improved. Undesirable swirling and in particular dead spaces are very substantially avoided. According to an advantageous alternative, the inner wall 20 can be provided with texturing to further improve the flow conditions in the downdraft extractor 4.

The cooking-fume inlet device 41 has an overall height h of approximately 15 cm. The overall height h of the cooking-fume inlet device 41 is in particular at most 30 cm, in particular at most 20 cm, in particular at most 15 cm. It is preferably at least 5 cm, in particular at least 10 cm. It therefore firstly has a compact design but secondly is optimized in respect of its fluidic properties. In addition, it is designed in such a manner that hobs 2 can be arranged in the worktop 9 in the region of the hob plane 8 next to the cooking-fume inlet device 41 without said hobs colliding with components of the downdraft extractor 4 that are arranged downstream of the cooking-fume inlet device 41 in the direction of flow 27. It is designed in particular in such a manner that, in the region of the channel 23, in particular in the region of a cooking-fume outlet opening of the cooking-fume inlet device 41, in which the channel 23 is connected in a flow-directing manner to subsequent parts of the downdraft extractor 4, sufficient space remains for arranging a hob 2 in the worktop 9 between an upper delimitation of the channel 23 and the hob plane 8.

An alternative of the insert 12 will be described below with reference to FIG. 9. The alternative according to FIG. 9 substantially corresponds to the alternative according to FIG. 8 to which reference is hereby made.

Figure 9:
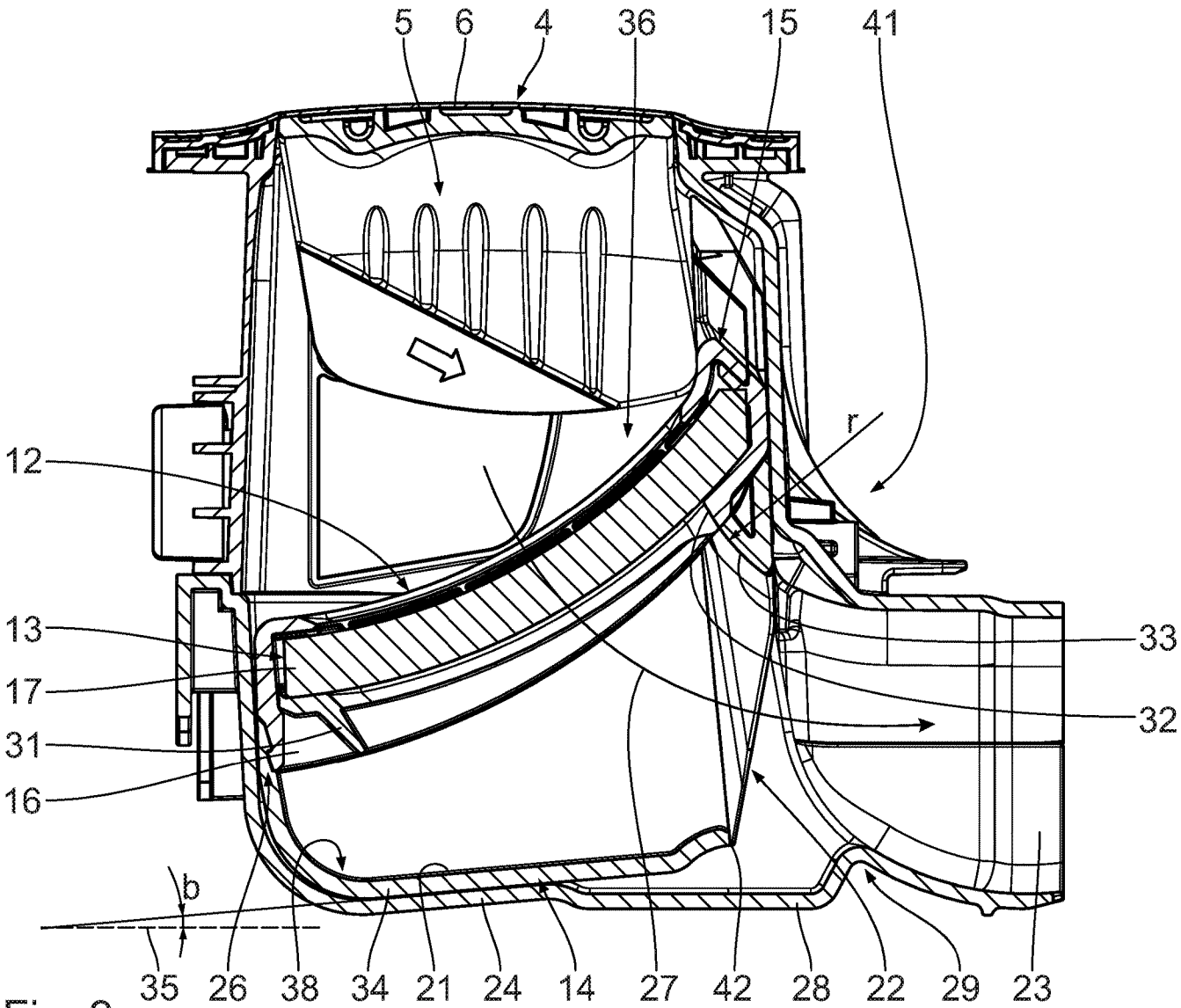
FIG. 9 is a view according to FIG. 8 with a further alternative of an insert for the downdraft extractor.

In the case of the alternative illustrated in FIG. 9, a flow-directing means 31, in particular in the form of a flow directing element or flow baffle, is provided on the frame 16 of the filter element 13 on the deflecting outer side of the direction of flow 27 of the stream of cooking fumes. The flow-directing means 31 is oriented in particular substantially parallel to a further flow-directing means 32 in the region of the inner radius r of the deflecting region for the stream of cooking fumes. The flow-directing means 32 continues in a flow directing surface 33 of the collecting element 14. A flow directing element, in particular a flow baffle, preferably serves as the flow-directing means 32.

The flow-directing means 31, 32 are composed of the same material as the frame 16 of the filter element 13 and/or the collecting trough 21. They are composed in particular of plastic.

The flow directing surface 33 forms a transition, in particular a rounded transition, in particular a substantially edge-free transition, to the channel 23. By means of the flow-directing means 32 and the flow-directing surface 33, in particular a deflection of the stream of cooking fumes about a sharp edge on the inner side of the deflecting region is avoided. By this means, the fluidic properties of the downdraft extractor 4 are considerably improved.

The deflecting region for the stream of cooking fumes in particular has a radius of curvature of at least 1 cm, in particular at least 2 cm, in particular at least 3 cm, in particular at least 5 cm, in the region of its inner radius.

In the case of the alternative illustrated in FIG. 9, the collecting trough 21 of the collecting element 14 has a bottom surface 34 which is designed in a manner rising slightly in the direction toward the cooking-fume outlet opening 22. In the inserted state of the insert 12, the bottom surface 34 has in particular an angle b within the range of 3° to 30° with a horizontal plane 35. The angle b is in particular at least 5°, in particular at least 10°. It is in particular at most 20°, in particular at most 15°. The effect achieved by the inclined design of the bottom surface 34 is that liquids accumulating in the collecting trough 21 collect in a rear region 38 of the collecting trough 21. The region, which lies opposite the cooking-fume outlet opening 22, at the bottom of the collecting trough 21 is referred to here as rear region 38. The rear region 38 forms a collecting region for the liquids to be collected. It furthermore forms a collecting region for grease running out of the grease filter 17.

The bottom wall 24 of the collecting trough 28 is likewise designed to be inclined at least in regions toward the horizontal plane 35. The bottom surface 34 of the collecting trough 21 lies in particular at least in regions flush against the bottom wall 24 of the collecting trough 28.

The bottom surface 34 of the collecting trough 21 has a separation edge 42 in the region of the cooking-fume outlet opening 22. The separation edge 42 is spaced apart from the lug 29 of the collecting trough 28.

The effect which can be achieved by the inclination of the bottom surface 34 is that the stream of cooking fumes is efficiently directed via the lug 29 into the adjoining channel 23. Heavier particles, for example droplets of grease, can remain here on the upstream side with respect to the lug 29 and accumulate in the collecting trough 28.

The lug 29 reliably prevents particles and/or liquids that have accumulated in the collecting trough 28 from being sucked into the channel 23 by the stream of cooking fumes.

The handle 15 of the filter element 13 is arranged outside a flow region 36 of the stream of cooking fumes. The flow region 36 extends perpendicularly downward, in particular perpendicularly with respect to the horizontal plane 35, in particular as an extension of the cooking-fume inlet opening 5. By means of an arrangement of the handle 15 outside the flow region 36, it can be avoided that the handle 15 leads to swirling of the stream of cooking fumes.

A further alternative of the insert 12 will be described below with reference to FIG. 10. The alternative according to FIG. 10 substantially corresponds to the alternative according to FIG. 9, to the description of which reference is hereby made.

Figure 10:
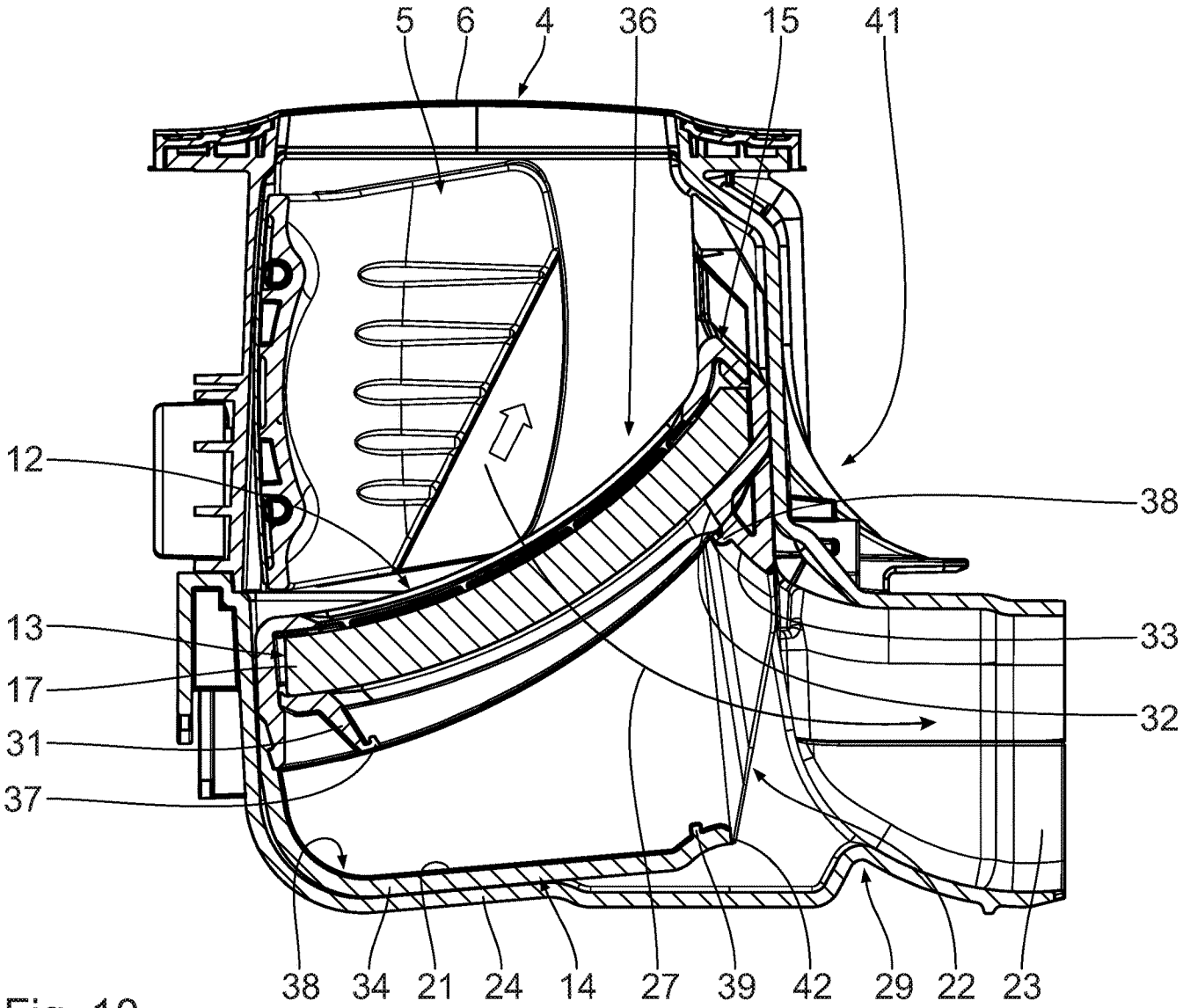
FIG. 10 is a view according to FIG. 8 with a further alternative of an insert for the downdraft extractor.

In the case of the alternative according to FIG. 10, a hook 37 is arranged on the flow directing element 31. The hook 37 is arranged on that side of the flow directing element 31 which faces the deflecting region. It serves for the specific production of swirling in the stream of cooking fumes. In other words, it forms a means for producing swirling. Swirling of this type can be used in order to increase the degree of grease removal in the insert 12. By means of the hook 37, in particular the degree of grease removal in the collecting element 14 can be increased.

Corresponding hooks 38, 39 are provided on the inner side of the deflecting region, in particular on the flow directing surface 33, and in the region of that end of the bottom surface 34 which faces the cooking-fume outlet opening 22.

The collecting element 14 is therefore provided with a plurality of swirl-producing means.

In the case of the alternatives described above, the filter element 13 and the collecting element 14 each form separate or separable parts of the insert 12. This is not absolutely necessary. The collecting element 14 can in particular also be formed as a single part with the filter element 13. A fluidically particularly favorable design of the insert 12 can thereby be achieved. In this case, the insert 12 forms a filter-collecting insert.

A further alternative of the insert 12 will be described below with reference to FIG. 11. The alternative according to FIG. 11 substantially corresponds to the alternative which is illustrated in FIG. 9 and to the description of which reference is hereby made.

Figure 11:
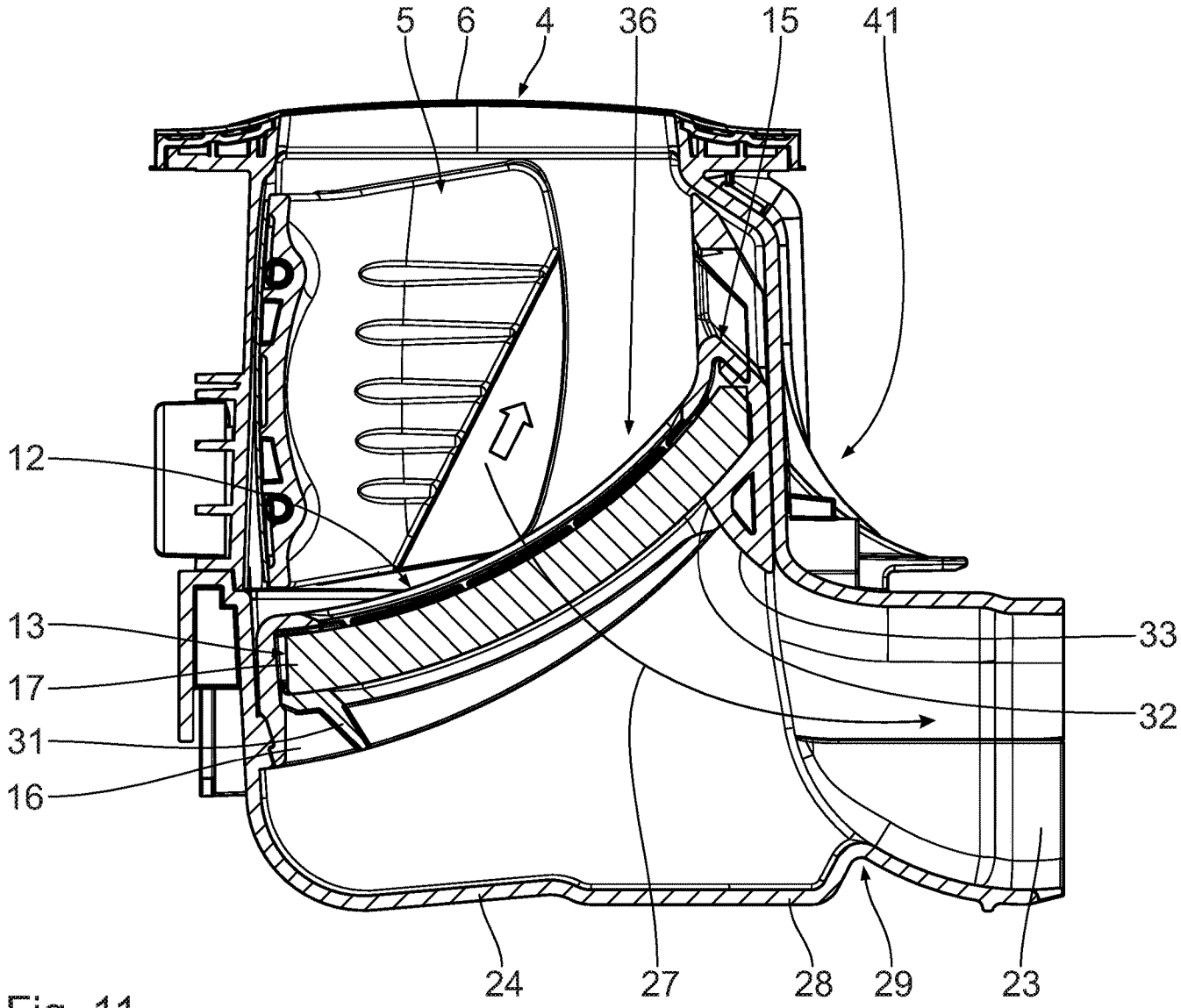
FIG. 11 is a view according to FIG. 8 with a further alternative of an insert for the downdraft extractor.

In the case of the alternative illustrated in FIG. 11, the insert 12 merely comprises the filter element 13 but not a collecting element 14. The filter element 13 lies directly on the collecting trough 28.

The flow directing element 32 is of extended design in such a manner that it forms the transition on the inner side of the flow to the channel 23. It is designed in particular in such a manner that it comprises the flow directing surface 33 which, in the case of the alternative according to FIG. 9, is part of the collecting trough 21.

Also in the case of the alternatives illustrated in FIGS. 9 and 10, it is possible for the bottom wall 24 of the collecting trough 28 to be of substantially flat design. It is possible in particular to design the bottom surface 34 of the collecting trough 21 in such a manner that the free end thereof in the region of the cooking-fume outlet opening 22 lies against the lug 29 of the collecting trough 28 in a manner corresponding to the alternative illustrated in FIG. 8. The bottom surface 34 of the collecting trough 21 can lie in particular substantially tightly, in particular liquid-tightly, against the lug 29. This prevents liquid, in particular grease, from penetrating the region between the collecting trough 21 and the collecting trough 28.

Figure 12:
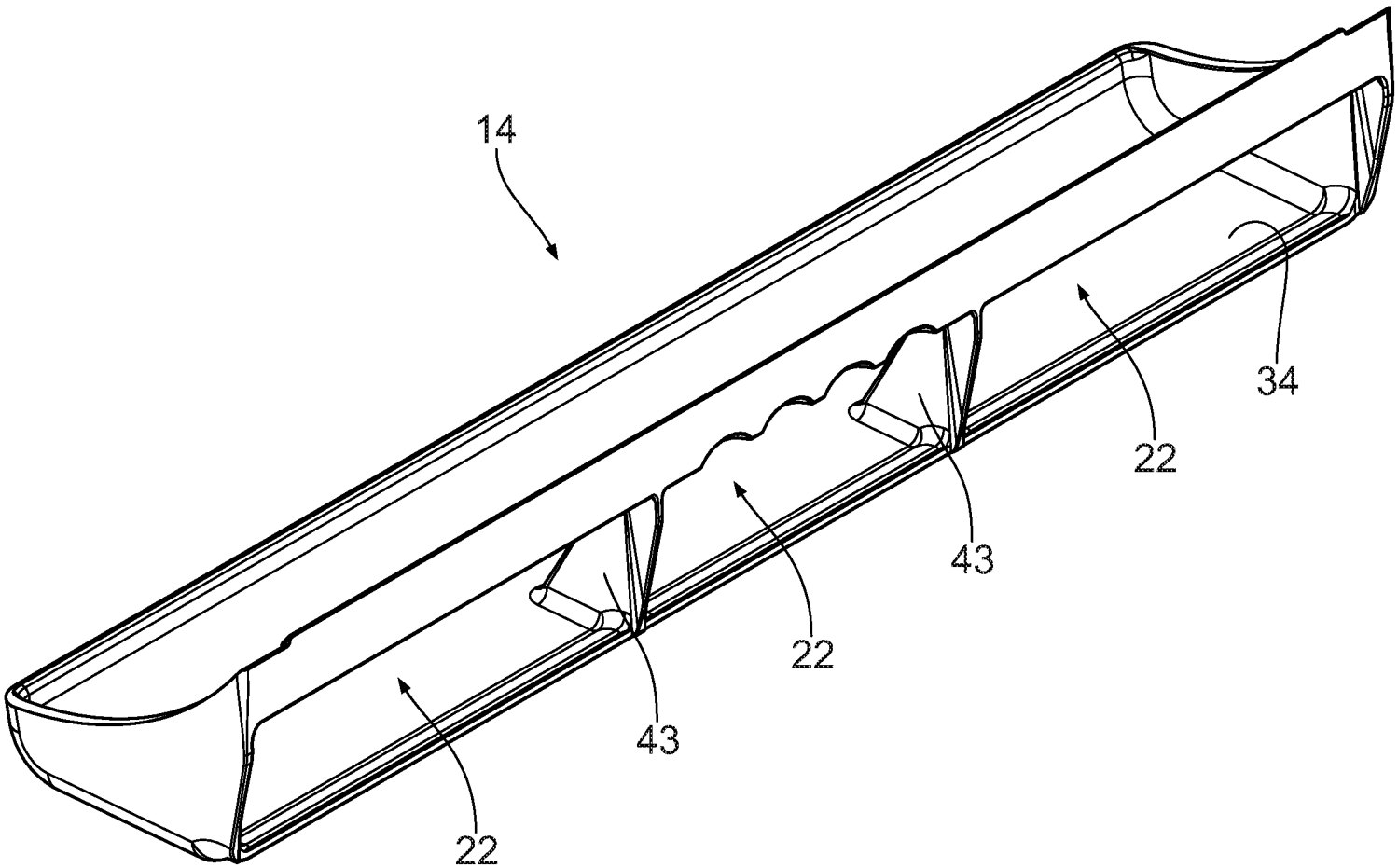
FIG. 12 is a view of an alternative of the collecting element.

FIG. 12 illustrates a further alternative of the collecting element 14. The embodiment substantially corresponds to the embodiment which is illustrated in FIG. 5 and to the description of which reference is hereby made.

In the case of the embodiment illustrated in FIG. 12, flow directing elements are provided in the collecting element 14 in the region of the cooking-fume outlet opening 22. In particular vertically oriented fins 43 serve as the flow directing element. In the embodiment illustrated, two fins 43 are provided. A different number of fins is also possible.

The fins 43 lead firstly to improving the flow properties and secondly to mechanical stabilization of the collecting element 14, in particular the bottom surface 34 thereof.

The fins 43 are preferably arranged in the direction of flow in alignment with corresponding flow directing elements in the channel 23 adjoining the collecting element 14. By means of corresponding flow directing elements, in particular the stability of the channel 23 can be improved.

The fins 43 have a flow-optimized shape. They are in particular wider in the region of the bottom surface 34 than in the region of the upper delimitation of the cooking-fume outlet opening 22.

The details of the different alternatives, in particular of the alternatives illustrated in FIGS. 8 to 12, can be combined substantially freely with one another. In particular, the different alternatives of the filter element 13 and of the collecting element 14 can be combined substantially freely with one another.

Different details of the invention will be described once again below in summary using different words.

The insert 12 with the filter element 13 and the collecting element 14 overall has a very low weight. The overall weight of the insert 12 can be in particular less than 3 kg, in particular less than 2 kg, in particular less than 1 kg. In particular, the weight of the collecting element 14 can be less than 1 kg, in particular less than 500 g, in particular less than 300 g. This facilitates the taking of the insert, in particular the collecting element 14, out of the downdraft extractor 4. The risk in particular is reduced of damage being caused by inadvertent dropping of the collecting element 14.

When the collecting element 14 and the filter element 13 are inserted into the downdraft extractor 4, they slide automatically into the positions provided for them. This is referred to as a self-centering property. This is assisted or made possible by a corresponding design of the housing of the downdraft extractor 4, in particular in the region of the cooking-fume inlet opening 5 and/or in the region of the collecting trough 28.

To assist the self-centering properties of the collecting element 14 and/or of the filter element 13, guide means which interact with said elements can be provided in particular in the housing of the downdraft extractor 4.

The collecting element 14 and the filter element 13 can be designed so as to at least partially overlap. They can also be designed so as not to overlap.

Upon insertion into the downdraft extractor 4, the filter element 13 automatically slides into the correct position relative to the collecting element 14.

While specific embodiments of the invention have been shown and described in detail to illustrate the application of the principles of the invention, it will be understood that the invention may be embodied otherwise without departing from such principles.

The invention claimed is:

1. An insert for a downdraft extractor, the insert comprising:

a filter element for filtering a stream of cooking fumes; and a collecting element for receiving liquids, wherein the filter element and the collecting element are detachably joined together via a connecting structure, wherein the collecting element has at least one wall providing a flow conducting surface for deflecting the stream of cooking fumes, wherein the at least one wall is at least one of curved and oblique at least in regions.

2. The insert as claimed in claim 1, wherein the collecting element and the filter element are configured to be joined together in a form-locking manner, the connecting structure comprising a filter element surface of the filter element engaging a collecting element surface of the collecting element to detachably connect the filter element to the collecting element.

3. The insert as claimed in claim 1, wherein the at least one wall is an inner wall of the collecting element facing in a direction of a cooking fume outlet opening of the collecting element, wherein the inner wall is substantially edge-free.

4. The insert as claimed in claim 1, wherein the filter element and the collecting element can be joined together such that a wall of the filter element and the at least one wall of the collecting element form a substantially edge-free flow conducting surface for deflecting the stream of cooking fumes, the substantially edge-free flow conducting surface being located opposite a cooking fume outlet opening of the collecting element.

5. The insert as claimed in claim 1, wherein guide means are provided on an outer side of at least one of the collecting element and the filter element and lead to a self-centering design of at least one of the collecting element and the filter element.

6. The insert as claimed in claim 1, wherein the filter element has at least one filter layer which is arcuate relative to a horizontally oriented axis, the filter element comprising an arcuate filter element portion, the collecting element comprising an arcuate collecting element portion.

7. The insert as claimed in claim 1, wherein at least one of the filter element and the collecting element is formed at least in regions from plastic, the filter element comprising a filter element frame, the filter element frame being in contact with the collecting element.

8. The insert as claimed in claim 1, wherein at least one signal-emitting element is arranged on at least one of the filter element and the collecting element.

9. The insert as claimed in claim 1, wherein the collecting element has a cooking-fume outlet opening in which at least one flow conducting element is arranged.

10. The insert as claimed in claim 9, wherein the filter element comprises a filter element longitudinal axis, the collecting element comprising a collecting element longitudinal axis, the collecting element longitudinal axis being parallel to the filter element longitudinal axis.

11. The insert as claimed in claim 1, wherein the at least one wall forms an outer wall of a flow channel for the stream of cooking fumes.

12. A downdraft extractor, comprising:

a removable insert comprising a filter element for filtering a stream of cooking fumes and a collecting element for receiving liquids, wherein the filter element and the collecting element are configured to be joined together, wherein the collecting element has at least one wall providing a flow conducting surface for deflecting the stream of cooking fumes, wherein the at least one wall is at least one of curved and oblique at least in regions, wherein at least one of the filter element and the collecting element in an inserted state form part of a flow channel for the stream of cooking fumes and wherein the collecting element comprises a wall defining a transition from the collecting element to the flow channel, the wall comprising an arcuate portion and the wall being substantially edge-free.

13. The downdraft extractor as claimed in claim 12, further comprising a removable maintenance trough.

14. The downdraft extractor as claimed in claim 12, wherein the collecting element in an inserted state rests at least in regions on a maintenance trough.

15. The downdraft extractor as claimed in claim 12, further comprising a maintenance trough which is able to be taken out.

16. The downdraft extractor as claimed in claim 12, wherein the collecting element comprises a cooking-fume outlet opening and an interior space in fluid communication with the cooking-fume outlet.

17. The downdraft extractor as claimed in claim 12, wherein the filter element comprises a filter element longitudinal axis, the collecting element comprising a collecting element longitudinal axis, the collecting element longitudinal axis being parallel to the filter element longitudinal axis.

18. A hob system, comprising:

at least one hob; and at least one downdraft extractor comprising a removable insert, the removable insert comprising a filter element for filtering a stream of cooking fumes and a collecting element for receiving liquids, wherein the filter element and the collecting element are configured to be joined together, wherein the collecting element has at least one wall providing a flow conducting surface for deflecting the stream of cooking fumes, wherein the at least one wall is at least one of curved and oblique at least in regions and the filter element and the collecting element are configured to be joined together such that a wall of the filter element and a wall of the collecting element form a substantially edge-free flow directing surface for deflecting the stream of cooking fumes in a direction of a cooking fume outlet of the collecting element.

19. The hob system as claimed in claim 18, wherein the filter element comprises a filter element longitudinal axis, the collecting element comprising a collecting element longitudinal axis, the collecting element longitudinal axis being parallel to the filter element longitudinal axis, the filter element comprising an arcuate filter element portion, the filter element comprising a filter element surface, the collecting element comprising a collecting element surface, the filter element surface cooperating with the collecting element surface to define at least a portion of a connecting structure, the collecting element being detachably connected to the filter element via the connecting structure.

* * * * *